US006766814B2

(12) United States Patent
Perreault

(10) Patent No.: US 6,766,814 B2
(45) Date of Patent: Jul. 27, 2004

(54) COLLAPSIBLE UMBRELLA

(76) Inventor: Jean-Rene Perreault, 3046 Ave des Trois-Sœurs RR4, Sainte-Julienne, QC (CA), J0K 2T0

( * ) Notice: Subject to any disclaimer, the term of this patent is extended or adjusted under 35 U.S.C. 154(b) by 18 days.

(21) Appl. No.: 10/330,226

(22) Filed: Dec. 30, 2002

(65) Prior Publication Data

US 2004/0123890 A1 Jul. 1, 2004

(51) Int. Cl.[7] ..... A45B 25/44
(52) U.S. Cl. ..... 135/31
(58) Field of Search ..... 135/19.5, 20.3, 135/31, 23; 211/196

(56) References Cited

U.S. PATENT DOCUMENTS

| | | | | |
|---|---|---|---|---|
| 2,143,978 A | * | 1/1939 | Eeles | 135/25.3 |
| 3,744,503 A | | 7/1973 | Wolff | |
| 3,765,433 A | * | 10/1973 | Futamura et al. | 135/15.1 |
| 3,844,301 A | | 10/1974 | Harrell | |
| 3,892,251 A | | 7/1975 | Warfield | |
| 4,259,974 A | | 4/1981 | de Polo | |
| 4,934,394 A | * | 6/1990 | Hermanson | 135/19.5 |
| 5,188,137 A | | 2/1993 | Simonelli | |
| 5,638,846 A | | 6/1997 | Basso | |
| 5,690,131 A | | 11/1997 | Voigt | |
| 5,960,806 A | | 10/1999 | Steiner | |
| 6,234,186 B1 | * | 5/2001 | Tsai | 135/25.33 |
| 6,273,111 B1 | | 8/2001 | Weiss et al. | |
| 6,371,140 B1 | | 4/2002 | Atanda | |
| 2003/0041889 A1 | * | 3/2003 | Lin et al. | 135/16 |

* cited by examiner

*Primary Examiner*—Leslie A. Braun
*Assistant Examiner*—Kofi Schulterbrandt

(57) ABSTRACT

Collapsible umbrella having a resilient rib tensioning member connected to an end portion of the central shaft and interconnected with a first rib end portion and a second end portion. In response to moving forces against the rib connector it moves from a default position to a first, a second and a third open position to a second to a third. In the first open position, the rib tensioning member exerts a first threshold holding force on the second rib end portion, whereas in the second position, a second threshold holding force holds the second rib end portion, which is greater than the first. The rib tensioning member exerts a third threshold holding force on the second rib end portion, which is less than the second threshold holding force. The ribs having a rib weight sufficient to bias the second rib end portions towards a mounting surface.

15 Claims, 6 Drawing Sheets

COLLAPSIBLE UMBRELLA

FIELD OF THE INVENTION

The present invention concerns umbrellas, more particularly collapsible umbrellas.

BACKGROUND OF THE INVENTION

Collapsible temporary shelters, such as umbrellas and canopies, are well known. Conventionally, an umbrella is used to protect a user against the effects of snow, rain, sun and such, and consists of a canopy supported by a collapsible frame that is mounted on a central shaft. While this simple device is quick to deploy and provides shelter for the user, it suffers from a number of drawbacks. When the conventional umbrella is deployed, the canopy sweeps out a relatively large area before achieving its fully opened sheltering configuration. Disadvantageously, objects located near the umbrella may need to be moved or they may impede the umbrellas' deployment. Also, a user, who may be lying or sitting beside the umbrella, for example sunbathing, who becomes desirous of shade, must move away from the umbrella to deploy it.

A few designs for collapsible umbrellas exist, including:

U.S. Pat. No. 6,273,111 issued Aug. 14, 2001 to D. Weiss and S. Peace for "Retractable Umbrella".

U.S. Pat. No. 5,690,131 issued Nov. 25, 1997 to B. Voigt, for "Umbrella".

U.S. Pat. No. 5,188,137 issued Feb. 23, 1993 to A. F. Simonelli for "Umbrella".

These umbrellas, however, suffer from a number of important disadvantages. Each is of a complicated design having many moving parts, which may be prone to jamming. Disadvantageously, the canopy is drawn into the central shaft by a series of flexible, lightweight ribs, which the user collapses. The collapsible ribs, when in an open configuration, may be prone to undesired inversion by sudden gusts of wind. In addition, the collapsible ribs do not appear to be sufficiently reinforced to be self supporting and may frictionally contact the canopy causing damage after prolonged use. Furthermore, the low reinforcement may also limit the size of the area to be covered by the canopy.

Thus there is a need for an improved collapsible umbrella.

SUMMARY OF THE INVENTION

The present invention is directed towards such a solution.

A portable, collapsible umbrella of the present invention provides a novel tensioning system, which includes a number of rigid or resilient curved rods and a number of longitudinally resilient cables, which operate in combination with the umbrella rib weight to allow a bottom up method of canopy deployment. In addition, the combination helps to stabilize the open umbrella canopy and to reduce canopy inversion. The novel tensioning system also increases the size of area covered by the canopy by maintaining a strong holding force on the deployed canopy. The bottom up method of deployment enables a user to open the umbrella without temporarily obstructing the area immediately around the umbrella or knocking over objects in the immediate area around the umbrella. Also, the bottom up method enables the user to open umbrella while in a supine position. The umbrella is inexpensive to manufacture, simple to operate, strong, yet lightweight and portable thereby allowing the user to set up the umbrella quickly and to move the umbrella to other areas when required. The umbrella is adaptable to include side panels or drapes which can be attached to the canopy to provide shelter from strong wind or blowing materials such as sand on a beach. The novel tensioning system may also be adapted to provide temporary shelter to cars, to a temporary aid stations mounted alongside a vehicle, to boats or to a small portable protected-observatory for a hunter or a birdwatcher.

In a first aspect of the present invention, there is provided a collapsible umbrella having a rib connector slidably mounted on a central shaft, a plurality of umbrella ribs, each rib having a first rib end portion and a second rib end portion, the first rib end portion being movably connected to the rib connector, and a flexible canopy covering the ribs, the umbrella comprises:

a resilient rib tensioning member connected to an end portion of the central shaft, the rib tensioning member being interconnected with the first rib end portion and the second end portion, such that:

i) in response to a first moving force against the rib connector, the rib connector moves from a default position to a first open position, the default position being when the umbrella is collapsed, the ribs lying generally adjacent the central shaft, the rib connector being positioned towards a mounting surface and away from the tensioning member, the second rib end portion being positioned towards the rib tensioning member, the first open position being when the second rib end portion is positioned away from the rib tensioning member, the rib connector being positioned away from the mounting surface, the rib tensioning member exerting a first threshold holding force on the second rib end portion;

ii) in response to a second moving force against the rib connector, the rib connector moves from the first open position to a second open position, the second moving force being greater than the first moving force, the second open position being when the rib connector and the second rib end portion lie along a plane generally horizontal to the mounting surface, the rib tensioning member exerting a second threshold holding force on the second rib end portion, the second threshold holding force being greater than the first threshold holding force;

iii) in response to a third moving force against the rib connector, the rib connector moves from the second open position to a third open position, the third moving force being greater than the second moving force and the second threshold holding force, the third open position being when the second rib end portion is inclined generally away from the generally horizontal line towards the mounting surface, the rib connector being moved towards the rib tensioning member, the rib tensioning member exerting a third threshold holding force on the second rib end portion, the third threshold holding force being less than the second threshold holding force, the ribs having a rib weight sufficient to bias the second rib end portions towards the mounting surface.

In a further aspect, in response to a fourth moving force against the rib connector, the rib connector moves from the third position to the default position, the fourth moving force being sufficient to overcome the rib weight biasing, the rib tensioning member having sufficient resilient force to pull the ribs into the default position.

Typically, the resilient rib tensioning member comprises: a plurality of generally curved rods extending outwardly from the shaft end portion; and a plurality of cables connected to the rib connector and the second rib end portion, the cables being movably connected to the curved rods.

Typically, each curved rod includes a rod end portion directed away from a shaft axis.

Typically, the resilient rib tensioning member further comprises a guide system connected thereto. The guide system comprises a plurality of hoops attached to an underside of each of the rods. In one aspect, the guide member includes three hoops.

Typically, the hoops are sized to allow the cables to pass therethrough.

Typically, the curved rods are rigid. In one aspect, the curved rods are resilient.

Typically, the cables are longitudinally resilient.

Typically, the rib connector is a cylindrical collar having an axial bore of sufficient size to slide over the shaft.

Typically, a plurality of anchoring members are connected to an outer collar wall. Each rib is hingeably connected to the anchoring member.

Typically, the cylindrical collar includes a plurality of cable connector hoops extending upwardly therefrom for connecting each cable thereto. Other objects and advantages of the present invention will become apparent from a careful reading of the detailed description provided herein, with appropriate reference to the accompanying drawings.

BRIEF DESCRIPTION OF THE DRAWINGS

An embodiment of the present invention will now be disclosed, by way of example, in reference to the following drawings in which.

DETAILED DESCRIPTION OF THE PREFERRED EMBODIMENTS

With reference to the annexed drawings a preferred embodiments of the present invention will be herein described for indicative purpose and by no means as of limitation.

Figure 1:
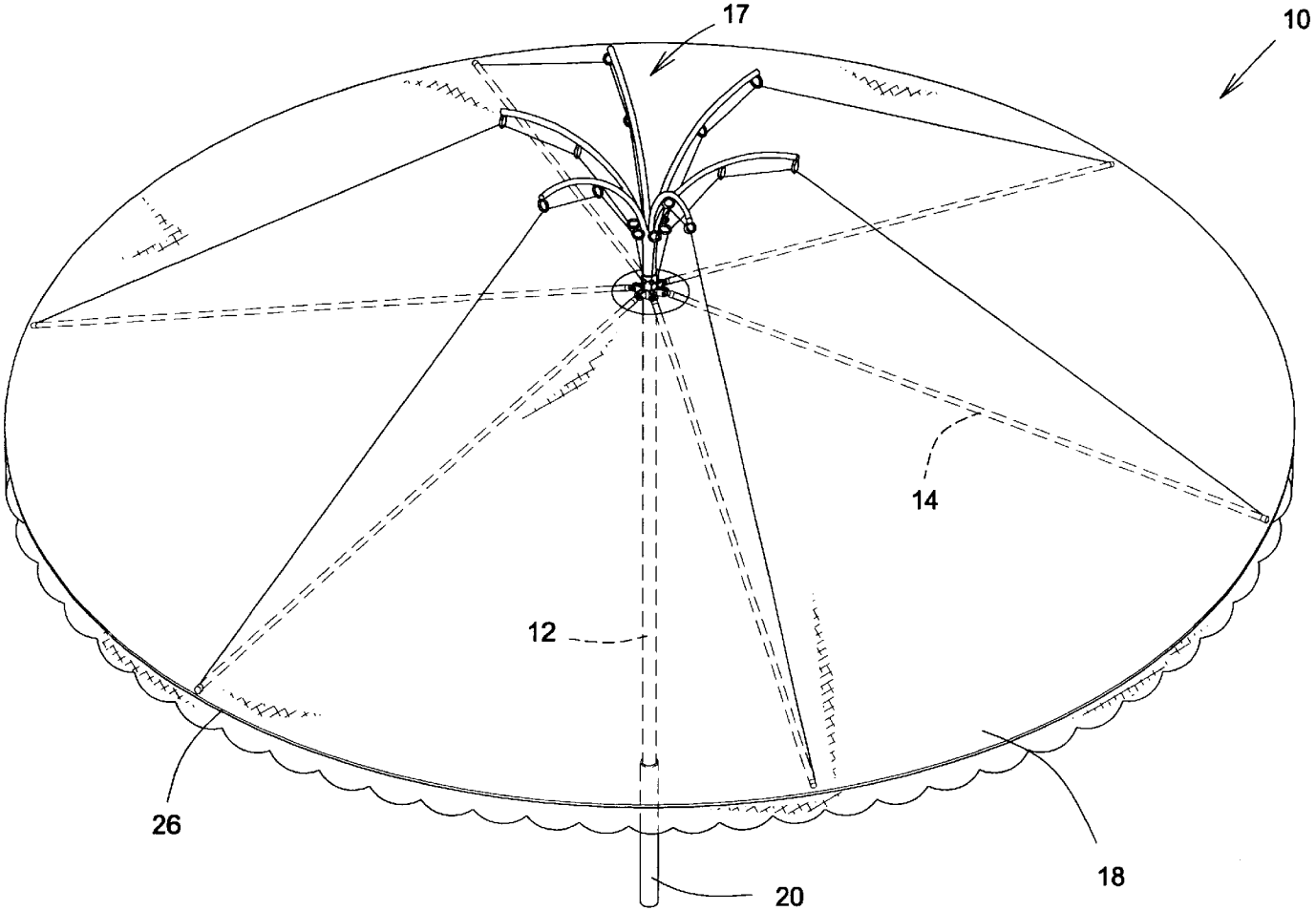
FIG. 1 is a perspective view of an embodiment of a collapsible umbrella of the present invention in a fully open configuration.
Figure 2:
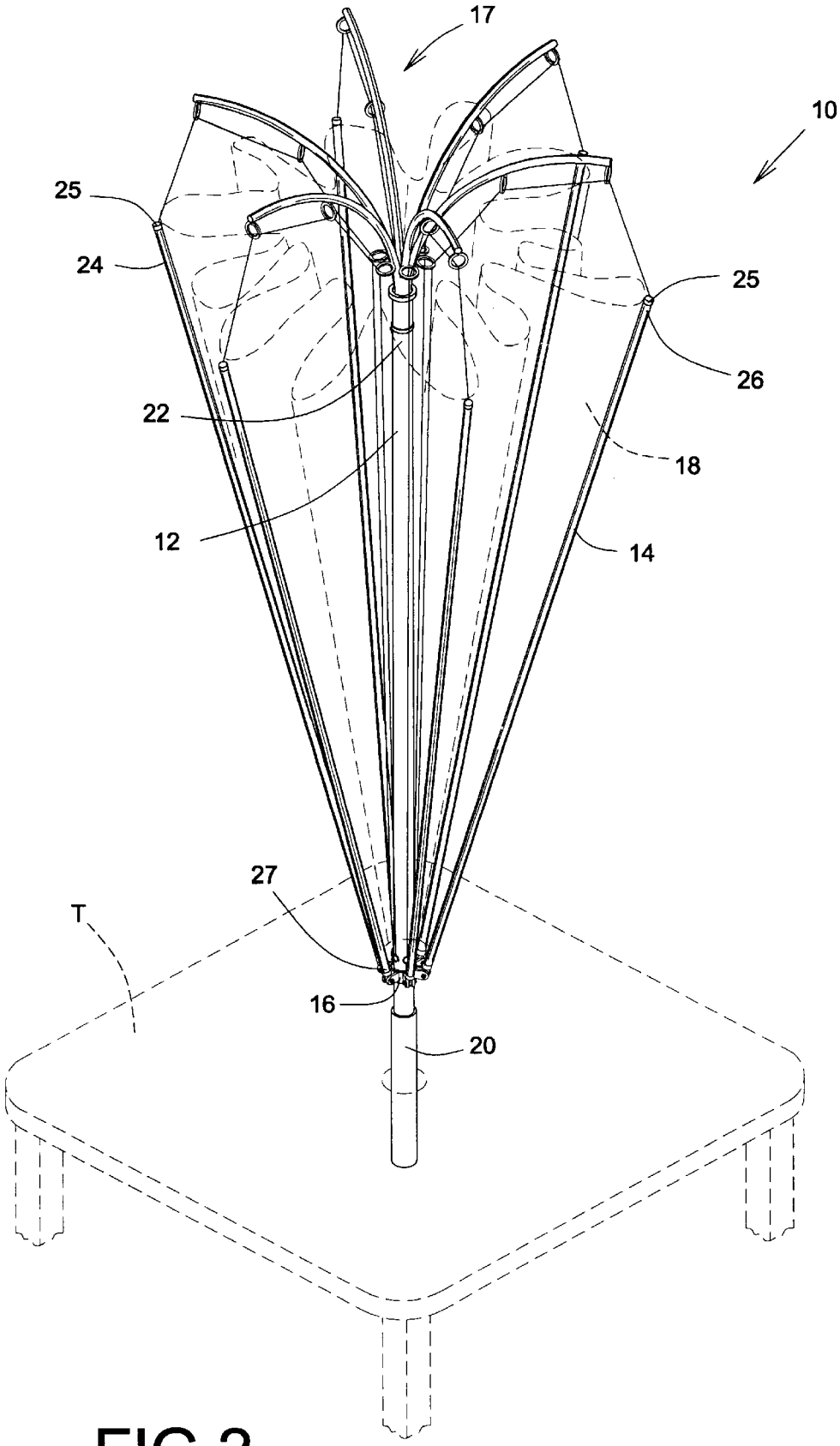
FIG. 2 is a perspective view of FIG. 1 showing the umbrella in a fully collapsed configuration.
Figure 3:
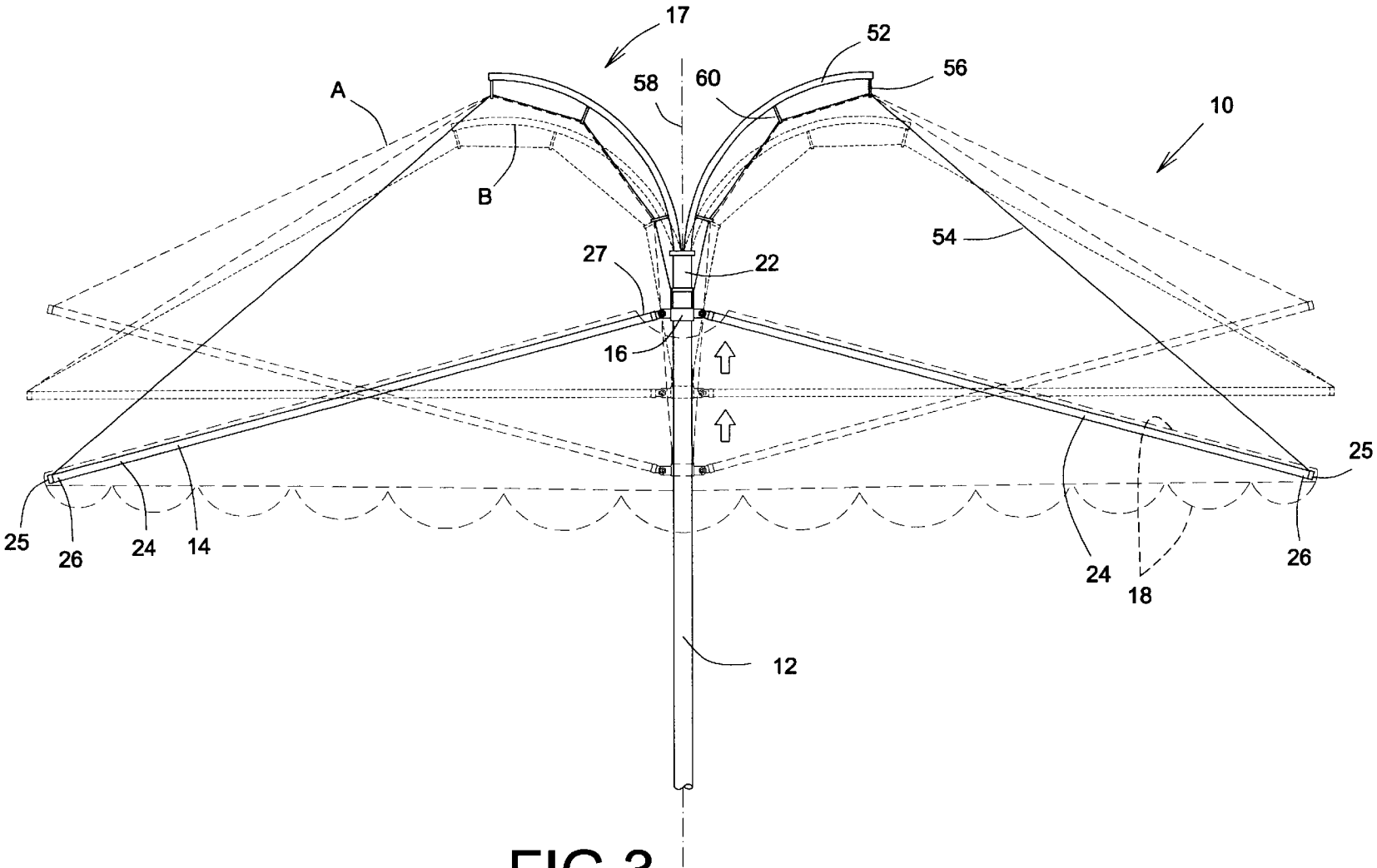
FIG. 3 is a side view of the umbrella of the present invention showing ribs in various positions.

Referring now to FIGS. 1, 2 and 3, a first embodiment of a collapsible umbrella is shown generally at 10. Generally, the collapsible umbrella 10 includes a central pole or shaft 12, a plurality of ribs 14, a rib connector 16, a resilient rib tensioning member 17 and a canopy 18. The canopy 18 is constructed of a flexible, durable material known to those skilled in the art, for example polyester, acrylic, canvas and the like. The shaft 12 includes a lower support end 20 and an upper end 22. Conventionally, the lower support end 20 may be mounted on a weighted stand or a table T, for stabilizing the umbrella 10 or the lower support end 20 may be temporarily dug into the ground to allow a user to move the umbrella to a position where sheltering is needed. The shaft 12 is constructed of lightweight material such as aluminum or stainless steel and depending upon the need may be hollow or solid. The shaft surface is normally smooth to allow the rib connector 16 to slide up and down thereon.

The ribs 14 extend radially outwardly from the rib connector 16. Each rib 14 includes a first rib end portion 24 and a second rib end portion 27. The first rib end portion 24 is located towards a rib tip 25 to which a canopy peripheral edge 26 is attached as will be described below.

Figure 6:
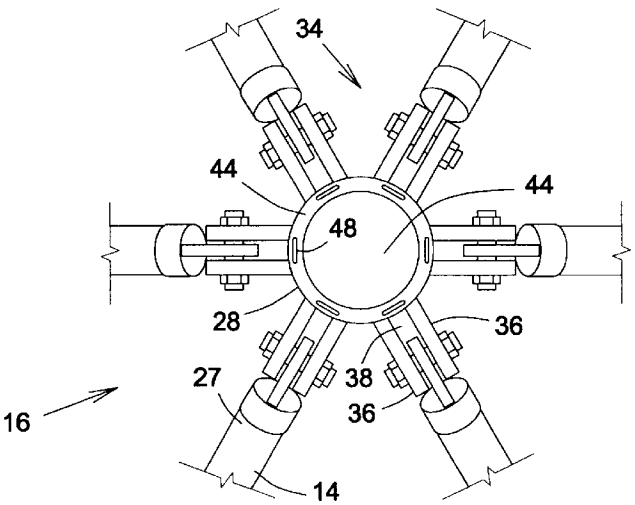
FIG. 6 is a top view of the rib connector of FIG. 5.
Figure 5:
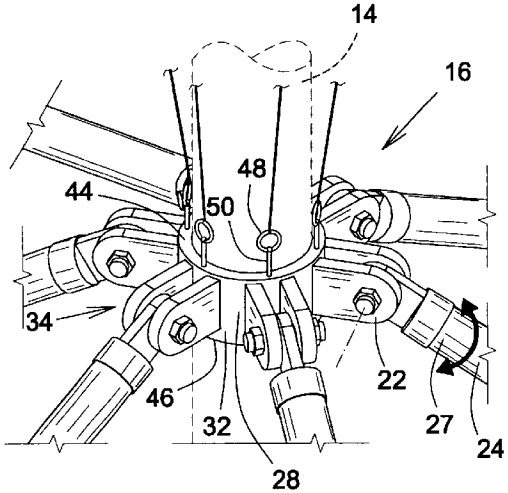
FIG. 5 is a partial perspective view of a rib connector of the present invention.
Figure 5A:
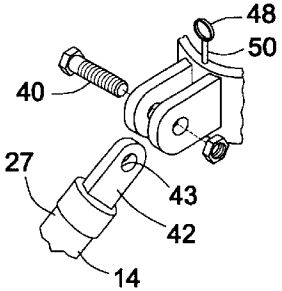
FIG. 5*a* is a partial exploded view of the rib connector of FIG. 5.

Referring now to FIGS. 5, 5a and 6, the rib connector 16 includes a cylindrical collar 28, which has an axial bore 30 sized to slide over the central shaft 12. The collar 28 has an outer wall 32 to which is connected a plurality of anchoring members 34. Each anchoring member 34 includes two panels 36 that define a gap 38 therebetween. A bolt 40 provides a means by which each rib 14 is movably attached. In this embodiment, each rib 14 is hingeably attached to the anchoring member to allow the ribs 14 to move in an arc about the bolt 40. The second rib end portion 27 includes a flattened portion 42, which includes a bolt hole 43 for receiving therein the bolt 40.

The rib connector 16 also includes an upper edge portion 44 and a lower edge portion 46. A plurality of cable connector hoops 48 are connected via a hoop stem 50 to the upper edge portion 44 and extend upwardly therefrom.

Figure 4:
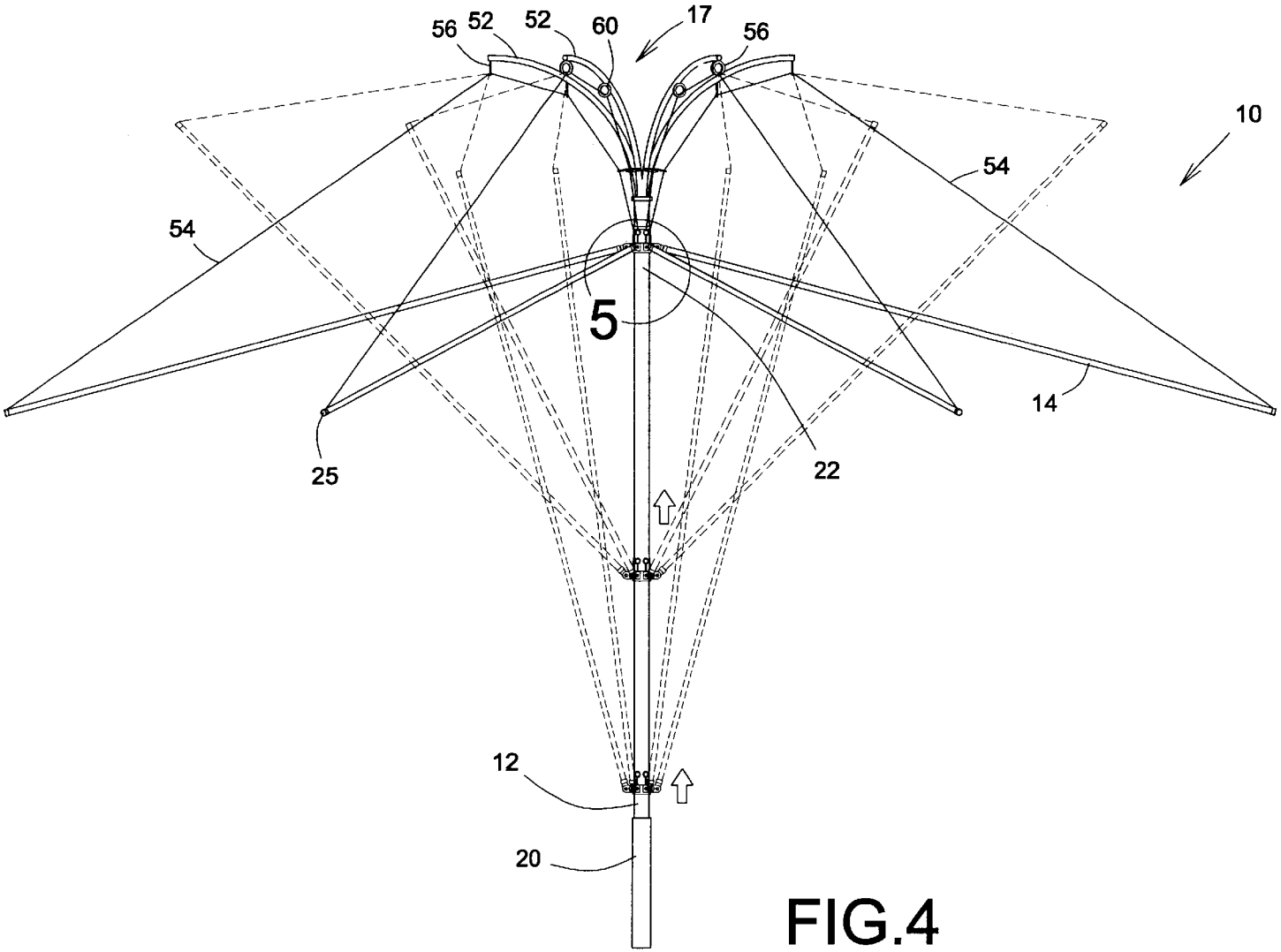
FIG. 4 is a partial perspective view of the umbrella of the present invention showing the ribs in various positions.

Referring now to FIGS. 3 and 4, the resilient rib tensioning member 17 includes a plurality of rigid or resilient, generally curved (bow-shaped) rods 52, extending from the shaft upper end 22, a plurality of cables 54 and a guide system 56. In this embodiment, the rib tensioning member 17 includes a hollow shaft portion (not shown) located at its base, which fits over the shaft upper end 22 and is welded thereto. The rib tensioning member 17 may also be attached by the use of bolts, rivets or by any commonly used attachment means. Each curved rod 52 curves generally outwardly and away from a shaft axis 58 and has attached to an underside, the guide system 56. The curved rods 52 may be constructed of materials such as wood, aluminum or graphite and the like. The guide system 56 includes a number of cable guide loops 60 through which the cables 54 pass during opening and closing of the canopy 18. Each cable 54 is attached to the connector hoops 48 and the rib tip 25. The cables 54 may be constructed of a longitudinally resilient material such as Nylon™ or polyester and the like.

Figure 8:
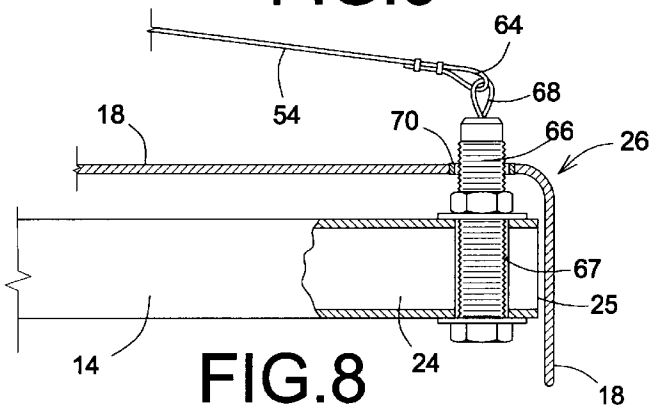
FIG. 8 is a partial cutaway side view showing a rib connected to a canopy.

Referring now to FIG. 8, the cables 54 include a cable loop 64 which is connected to a bolt 66 via a bolt loop 68. The bolt 66 passes through a hole 67 in the rib end 24, through an eyelet 70 located in the canopy 18 and is secured in place by nuts and washers.

While the cables 54 and guide system 56 are used specifically in this embodiment, one skilled in the art will recognize that the ribs and the rib tensioning member 17 may be a single piece of material such as those described above that has sufficient resilience to achieve the same desired results. Also, other guide systems are available which are within the scope of the invention such as pulleys. Furthermore, the guide system 56 may also include cables 54, which may be fed from the rib connector 16 through hollow ribs and attached to the rib end 24.

Operation

Generally, the collapsible umbrella 10 is supplied in a default, collapsed configuration, as illustrated in FIG. 1, in which the umbrella 10 is collapsed, and the ribs 14 are lying generally adjacent to the central shaft 12. The rib connector 16 is located towards a mounting surface 62 and away from the tensioning member 17. The second rib end portions 24 are positioned towards the rib tensioning member 17, thereby giving the umbrella a V-shaped appearance. Referring now to FIG. 3, a user, when shelter is required, applies a first upward moving force (in the direction of the arrows) against the rib connector 16 to move it to a first open position. For improved comfort, a sleeve of material slidably mounted on the central shaft 22 (not shown) may be used for the user to grip and push against the rib connector 16. Generally, the first open position is when the second rib end portion 24 is positioned away from the rib tensioning member 17 and the central shaft 12, and the rib connector 16 is moved up and away from the mounting surface 62. In this configuration (illustrated by A in FIG. 3), the cables 54 exert a first threshold holding force on the second rib end portions 24, as the user pushes up against the rib connector 16. To move the connector 16 out of the first open position, the user applies a second moving force upwards against the rib connector 16. This causes the rib connector 16 to move to a second open configuration. The second moving force is greater than the first moving force and causes the ribs 14 to exert an outward force and downward force on the second rib end portions 24. The outward and downward forces are generally equal to the cables' 54 resilience force, which is acting to pull the second rib end portion 24 back towards the rib tensioning member 17. In this configuration an equilibrium is set up and maintained by the equal and opposite forces of the cables 54 and the outward force of the second rib end portions 24. The second open position is when the rib connector 16 and the second rib end portion 24 lie along a plane generally horizontal to the mounting surface 62. The cables 54 exert a second threshold holding force on the second rib end portion, the second threshold holding force is greater than the first threshold holding force.

To achieve the final, or third open position, the user applies a third upward moving force against the rib connector 16 to move it from the second open position to the third open position. The third moving force must be sufficiently larger than the second moving force, to overcome the resilient forces acting against the second rib end portions 24. Once the third moving force overcomes the second threshold holding force, the rib connector 16 attains the third open position. In this position, the second rib end portion 24 is inclined generally down and away from the generally horizontal line towards the mounting surface 62. The rib connector 16 being moved upwards towards the rib tensioning member 17, such that the rib configuration resembles an inverted V-shape. In this position, the cables 54 exert a third threshold holding force on the second rib end portion 24, which is less than the second threshold holding force. At this stage, the hinged ribs 14 and the ribs' weight are sufficient to bias downward the second rib end portions 24. To collapse the umbrella back to the closed, default position, the user exerts a fourth downward pulling force against the rib connector 16. The pulling force on the rib connector.16 must be sufficient to overcome the rib weight biasing, and to allow the cables 54 to pull the ribs 14 back towards the central shaft 12 and into the default position.

Similarly, as illustrated by B in FIG. 3, the curved rods 52 may resiliently deform towards and away from the axis 58 to achieve the same results as when the curved rods 53 are rigid.

Alternative

Figure 7:
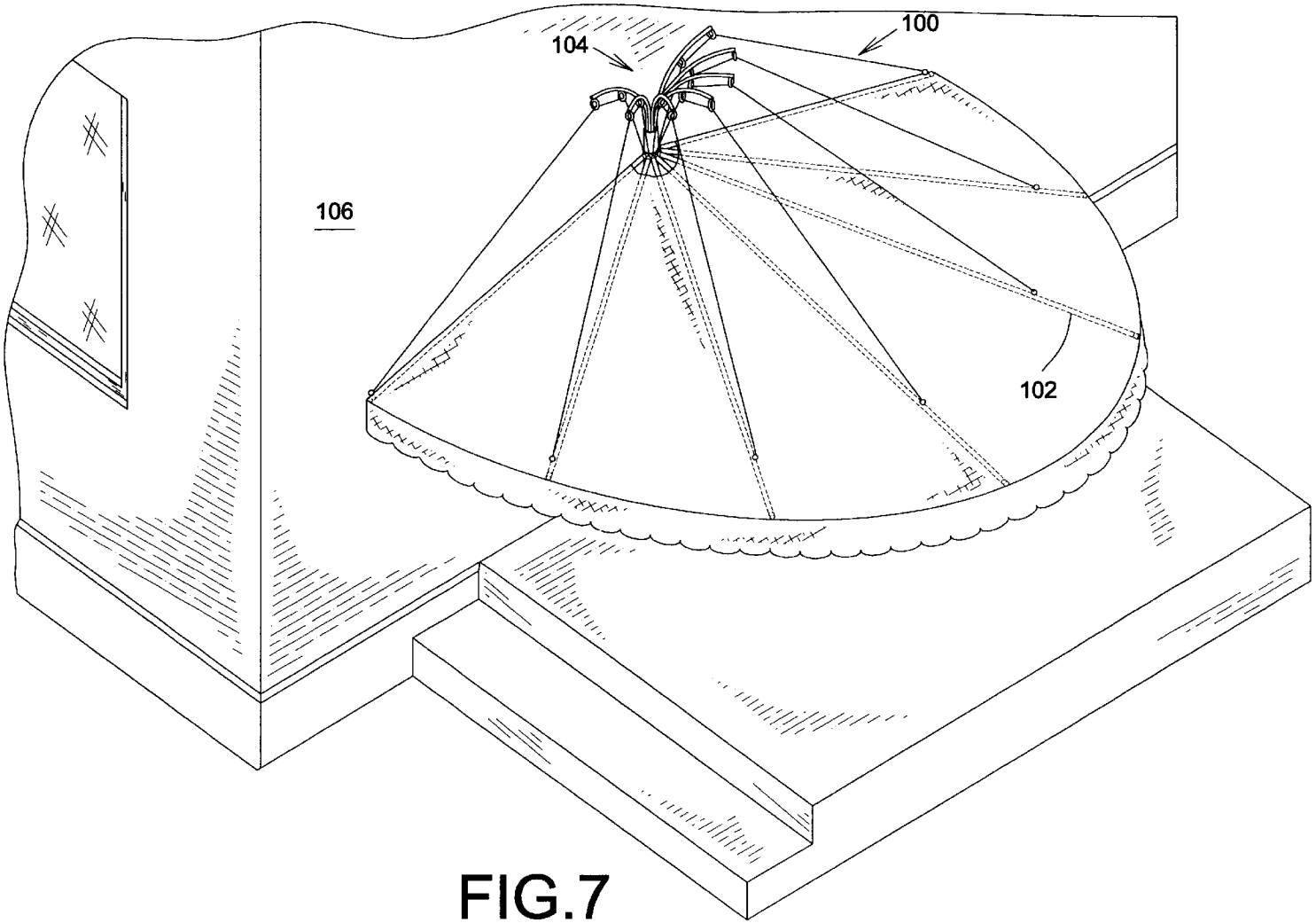
FIG. 7 is a perspective view of another embodiment of the present invention showing an open umbrella mounted against an exterior wall of a building.

The first embodiment of the collapsible umbrella 10 is useful as a portable, temporary shelter against the elements that allows the user to collapse the umbrella 10 and move it elsewhere or for storage. There may be times when a more permanently secured shelter is required, such as for shading of an area adjacent a wall, which umbrella may be collapsed when not in use. A collapsible umbrella according to a second embodiment 100 is shown in FIG. 7. Operation of the collapsible umbrella 100 is essentially identical to that of 10. The main difference between the umbrella 10 of the first embodiment and the umbrella 100 is that a plurality of ribs 102 extend partially around a rib tensioning member 104, the number and position of which depend on the adjacent structure and the extent of sheltering required by the user. The umbrella 100 shows a generally semi-circular design, which extends out from a vertical wall 106.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. Collapsible umbrella having a rib connector slidably mounted on a central shaft, a plurality of umbrella ribs, each rib having a first rib end portion and a second rib end portion, said first rib end portion being movably connected to said rib connector, and a flexible canopy covering said ribs, said umbrella comprising:

a resilient rib tensioning member connected to an end portion of said central shaft, said rib tensioning member being interconnected with said first rib end portion and said second end portion, such that:

i) in response to a first moving force against said rib connector, said rib connector moves from a default position to a first open position, said default position being when said umbrella is collapsed, said ribs lying generally adjacent said central shaft, said rib connector being positioned towards a mounting surface and away from said tensioning member, said second rib end portion being positioned towards said rib tensioning member, said first open position being when said second rib end portion is positioned away from said rib tensioning member, said rib connector being positioned away from said mounting surface, said rib tensioning member exerting a first threshold holding force on said second rib end portion;

ii) in response to a second moving force against said rib connector, said rib connector moves from said first open position to a second open position, said second moving force being greater than said first moving force, said second open position being when said rib connector and said second rib end portion lie along a plane generally horizontal to said mounting surface, said rib tensioning member exerting a second threshold holding force on said second rib end portion, said second threshold holding force being greater than said first threshold holding force;

iii) in response to a third moving force against said rib connector, said rib connector moves from said second open position to a third open position, said third moving force being greater than said second moving force and said second threshold holding force, said third open position being when said second rib end portion is inclined generally away from said generally horizontal line towards said mounting surface, said rib connector being moved towards said rib tensioning member, said rib tensioning member exerting a third threshold holding force on said second rib end portion, said third threshold holding force being less than said second threshold holding force, said ribs having a rib weight sufficient to bias said second rib end portions towards said mounting surface.

2. The umbrella, according to claim 1, in which in response to a fourth moving force against said rib connector, said rib connector moves from said third position to said default position, said fourth moving force being sufficient to overcome said rib weight biasing, said rib tensioning member having sufficient resilient force to pull said ribs into said default position.

3. The umbrella, according to claim 2, wherein said resilient rib tensioning member comprises:

a plurality of generally curved rods extending outwardly from said shaft end portion; and a plurality of cables connected to said rib connector and said second rib end portion, said cables being movably connected to said curved rods.

4. The umbrella, according to claim 3, wherein each curved rod includes a rod end portion directed away from a shaft axis.

5. The umbrella, according to claim 4, in which said resilient rib tensioning member further comprises a guide system connected thereto.

6. The umbrella, according to claim 5, wherein said guide system comprises a plurality of hoops attached to an underside of each of said rods.

7. The umbrella, according to claim 6, in which said guide member includes three hoops.

8. The umbrella, according to claim 7, in which said hoops are sized to allow said cables to pass therethrough.

9. The umbrella, according to claim 3, wherein said curved rods are rigid.

10. The umbrella, according to claim 3, wherein said curved rods are resilient.

11. The umbrella, according to claim 3, wherein said cables are longitudinally resilient.

12. The umbrella, according to claim 3, wherein said rib connector is a cylindrical collar having an axial bore of sufficient size to slide over said shaft.

13. The umbrella, according to claim 12, wherein a plurality of anchoring members are connected to an outer collar wall.

14. The umbrella, according to claim 13, in which each rib is hingeably connected to said anchoring member.

15. The umbrella, according to claim 12, wherein said cylindrical collar includes a plurality of cable connector hoops extending upwardly therefrom for connecting each cable thereto.

* * * * *